US007748551B2

(12) United States Patent
Gatewood et al.

(10) Patent No.: US 7,748,551 B2
(45) Date of Patent: Jul. 6, 2010

(54) HOT FILL CONTAINER WITH RESTRICTED CORNER RADIUS VACUUM PANELS

(75) Inventors: Erik E. Gatewood, Lafayette, CO (US); Brian D. Tyree, Thornton, CO (US); John J. Livingston, Denver, CO (US)

(73) Assignee: Ball Corporation, Broomfield, CO (US)

( * ) Notice: Subject to any disclaimer, the term of this patent is extended or adjusted under 35 U.S.C. 154(b) by 748 days.

(21) Appl. No.: 11/061,293

(22) Filed: Feb. 18, 2005

(65) Prior Publication Data

US 2006/0186082 A1 Aug. 24, 2006

(51) Int. Cl.
*B65D 90/02* (2006.01)

(52) U.S. Cl. ..... 215/381; 215/382; 220/675; 220/669

(58) Field of Classification Search ..... 215/379, 215/DIG. 6, DIG. 12, DIG. 14; D9/567, D9/549, 537, 530, 516
See application file for complete search history.

(56) References Cited

U.S. PATENT DOCUMENTS

| | | | | |
|---|---|---|---|---|
| D80,447 | S * | 2/1930 | McKay | D9/554 |
| D262,521 | S | 1/1982 | Frahm et al. | |
| 4,805,788 | A | 2/1989 | Akiho | |
| 4,824,787 | A * | 4/1989 | Serkes et al. | 435/299.2 |
| 4,877,141 | A | 10/1989 | Hayashi et al. | |
| 4,907,709 | A | 3/1990 | Abe et al. | |
| D313,750 | S | 1/1991 | York et al. | |
| D315,869 | S | 4/1991 | Collette | |
| 5,005,716 | A | 4/1991 | Eberle | |
| D316,964 | S | 5/1991 | York | |
| D316,966 | S | 5/1991 | York | |
| D316,967 | S | 5/1991 | York | |
| D316,968 | S | 5/1991 | York | |
| D318,799 | S | 8/1991 | York | |
| D321,136 | S | 10/1991 | York | |
| 5,054,632 | A | 10/1991 | Alberghini et al. | |
| D321,830 | S | 11/1991 | York et al. | |
| 5,092,475 | A | 3/1992 | Krishnakumar et al. | |
| 5,178,289 | A * | 1/1993 | Krishnakumar et al. | 215/382 |
| 5,178,290 | A | 1/1993 | Ota et al. | |
| 5,222,615 | A | 6/1993 | Ota et al. | |
| 5,224,614 | A * | 7/1993 | Bono et al. | 215/384 |
| 5,261,543 | A | 11/1993 | Ugarelli | |
| 5,279,433 | A * | 1/1994 | Krishnakumar et al. | 215/381 |

(Continued)

*Primary Examiner*—Anthony Stashick
*Assistant Examiner*—Robert J Hicks
(74) *Attorney, Agent, or Firm*—Brinks Hofer Gilson & Lione

(57) ABSTRACT

A thin walled, plastic hot-fill container has a finish to receive a closure, a neck supporting the finish, a shoulder situated below the neck, a base, and a body between the shoulder and base. The body includes upper and lower margins defining a label mount area that includes a plurality of inwardly recessed vacuum panels separated by vertical posts. At least one indented reinforcing ring separates the upper and lower edges of the vacuum panels from the adjacent margins of the label mount area by a distance D. Each vacuum panel includes an inclined upper and lower margin of height H that is greater than distance D, and has corners defined by radius R, which is less than or equal to D. Lateral margins of each vacuum panel extend vertically between the corners and connect the adjacent posts to a central depressed region, each lateral margin being essentially perpendicular to the adjacent surface of the vacuum panel.

22 Claims, 4 Drawing Sheets

U.S. PATENT DOCUMENTS

D345,693 S 4/1994 Edstrom
5,303,833 A 4/1994 Hayashi et al.
5,303,834 A * 4/1994 Krishnakumar et al. ..... 215/381
5,337,909 A 8/1994 Vailliencourt
5,341,946 A 8/1994 Vailliencourt et al.
D352,238 S 11/1994 Vailliencourt et al.
D352,245 S 11/1994 Krishnakumar et al.
5,407,086 A * 4/1995 Ota et al. ..... 215/383
5,472,105 A * 12/1995 Krishnakumar et al. ..... 215/384
D366,416 S 1/1996 Semersky
D366,417 S 1/1996 Semersky
D366,831 S 2/1996 Semersky et al.
5,690,244 A 11/1997 Darr
5,704,503 A 1/1998 Krishnakumar et al.
5,704,504 A * 1/1998 Bueno ..... 215/381
D393,802 S 4/1998 Collette et al.
D396,810 S 8/1998 Riffer
D397,614 S 9/1998 Krishnakumar et al.
D411,453 S 6/1999 Piccioli et al.
5,908,127 A * 6/1999 Weick et al. ..... 215/373
5,908,128 A 6/1999 Krishnakumar et al.
D413,519 S * 9/1999 Eberle et al. ..... D9/538
5,971,184 A 10/1999 Krishnakumar et al.
5,975,342 A * 11/1999 Bradeen et al. ..... 220/737
6,016,932 A 1/2000 Gaydosh et al.
D419,882 S 2/2000 Bretz et al.
D420,592 S 2/2000 Bretz et al.
6,036,037 A 3/2000 Scheffer et al.
6,044,996 A 4/2000 Carew et al.
6,062,409 A 5/2000 Eberle
6,131,732 A * 10/2000 Schneider ..... 206/217
D434,330 S 11/2000 Rowe et al.
6,164,474 A * 12/2000 Cheng et al. ..... 215/384
D445,033 S 7/2001 Bretz et al.
6,257,433 B1 * 7/2001 Ogg et al. ..... 215/381
D448,303 S 9/2001 Cheng et al.
6,347,717 B1 2/2002 Eberle
6,460,714 B1 10/2002 Silvers et al.
D472,470 S 4/2003 Bretz et al.
D476,236 S 6/2003 Ungrady et al.
6,585,125 B1 * 7/2003 Peek ..... 215/381
D479,690 S 9/2003 DeGroff
6,626,324 B1 9/2003 Boyd
D480,313 S 10/2003 Johnson et al.
D494,475 S * 8/2004 Thierjung et al. ..... D9/538
D497,551 S 10/2004 Gamel et al.
6,830,158 B2 * 12/2004 Yourist ..... 215/381
D502,108 S 2/2005 Gamel et al.
6,920,992 B2 7/2005 Lane et al.
6,932,230 B2 8/2005 Pedmo et al.
7,021,479 B2 * 4/2006 Pedmo et al. ..... 215/381
2004/0000533 A1 * 1/2004 Kamineni et al. ..... 215/373
2004/0200799 A1 * 10/2004 Yourist et al. ..... 215/381
2005/0045645 A1 * 3/2005 Tsutsui et al. ..... 220/669
2005/0051509 A1 * 3/2005 Bysick et al. ..... 215/381
2006/0054587 A1 * 3/2006 Oguchi et al. ..... 215/381
2006/0157438 A1 * 7/2006 Livingston et al. ..... 215/381

* cited by examiner

HOT FILL CONTAINER WITH RESTRICTED CORNER RADIUS VACUUM PANELS

BACKGROUND OF THE INVENTION

The present invention relates to blow-molded containers of biaxially oriented thermoplastic materials, typically polyethylene terephthalate, that are especially adapted to be filled with a hot liquid or semi-liquid product and hermetically sealed, and which are generally referred to as thin-walled hot-fill containers. The invention particularly relates to improvements in container design to achieve a filled container that, when cooled, retains a desired container configuration despite the development of a partial vacuum within the container, and provides enhanced support of any label applied to the container even when subjected to sidewall impact.

Thin-wall hot-fill containers are typically used for packaging of liquids which must be placed in the container while hot for aseptic packaging. During the filling process, the container is subjected to elevated temperatures and may be subjected to some small positive internal pressures. The container is immediately capped so that no appreciable cooling or contamination of the container contents occurs prior to the hermitic sealing. As the product subsequently cools, a negative internal pressure is formed in the sealed container. Any flexible wall of the container will elastically deform inward to the extent necessary to at least partially reduce the negative pressure within the container. Thin-wall hot-fill containers of the prior art typically include a plurality of vacuum panels specially designed to elastically deform in a controlled manner, thus preventing any large uncontrolled shape distortion. The vacuum panels are typically arranged around the circumference of a middle portion of the container and are typically covered by a wrap-around label held within the margins of an area commonly identified as the label panel.

Many styles and geometric patterns have been developed for the vacuum panels. The variations are all intended to address various concerns about the container performance and shape retention when dropped, when vertically stacked, when pinched by manually gripping the container, etc. To address these concerns the vacuum panels often include raised central wall portions, post areas between the vacuum panels, circumferential land areas above and below the vacuum panels, longitudinal and circumferential recessed ribs, hinge portions, etc. As the wall thickness of the containers is reduced from the already thin dimension of typically less than ½ mm, the various problems associated with thin-wall hot-fill containers become exacerbated. A particularly difficult problem is presented by side impacts that tend to permanently deform the sidewall of the container. A more general problem is the competing desires of providing sufficient stiffness in specific areas of the label panel, while still permitting other areas to yield in the intended manner for successful hot-fill performance. A common problem arises in the area of and outside each corner of the vacuum panels, where creases can develop that can contribute to large scale deformation of the container side wall.

What is needed is a thin-wall hot-fill container that provides a large range of flexibility while retaining sufficient support of any label applied to the container even when subjected to sidewall impact. What is particularly needed is a thin-wall hot-fill container that provides for enhanced resistance to container deformation is the area of the vacuum panel corners.

SUMMARY OF THE INVENTION

These several needs are satisfied by a container of the present invention, which has a finish adapted to receive a closure sealing the container, a neck situated below and supporting the finish, a shoulder portion situated below the neck, a base, and a body portion connecting the shoulder portion to the base. The body portion includes upper and lower margins defining a label mount area between the margins, the label mount area including a plurality of inwardly recessed vacuum panels separated by vertical posts. Each of the vacuum panels includes an upper edge and a lower edge, each edge being spaced from the upper and lower margins of the label mount area. At least one indented reinforcing ring, which can be circumferentially continuous or discontinuous, separates the upper and lower edges of the vacuum panels from the adjacent margins of the label mount area. The upper and lower edges of each vacuum panel have an included inclined margin, while the lateral edges of each vacuum panel have substantially radial margins. The corners of each vacuum panel are small as compared to the inclined margins of the panels, which reduces the opportunity for vacuum induced changes in conformation of the central portion of the vacuum panel to propagate outward from the corners.

Each vacuum panel of a thin-walled hot-fill plastic container of the present invention has lateral edges that are separated from the immediately adjacent vacuum panels by posts of width W. The upper and lower margins of each vacuum panel are spaced from the adjacent reinforcing ring by a distance D that is preferably smaller than W. The vertical extent H of each of the included inclined margins is preferably greater than D. The height or vertical extent H of the included inclined margins can be less than W. The vacuum panel corners are defined by a radius R that preferably is less than about 1.2 D.

The lateral margins of each vacuum panel of a thin-walled hot-fill plastic container of the present invention extend vertically continuously from corner to corner. Each lateral margin lies essentially in a plane that is substantially perpendicular to the adjacent margin of the central depressed region of the vacuum panel. Each lateral margin connects a post outer surface to a central depressed region of one of the vacuum panels. The central depressed region of each vacuum panel can include an outwardly protruding central element. Any such outwardly protruding central element will be generally spaced from the margins of the vacuum panel by a distance that is greater than W. The outwardly protruding central element can have a width that is less than W. The outwardly protruding central element can protrude outwardly by a distance that is less than the radial extent of the lateral margins. That is, the outer surface of the outwardly protruding central element of each vacuum panel can be spaced from the container longitudinal axis by a distance that is less than the spacing between the outer surface of the posts and the container longitudinal axis. The central depressed region of each vacuum panel surrounding any outwardly protruding central element can be spaced uniformly from the container longitudinal axis.

A thin-walled hot-fill plastic container of the present invention can have an indented ring that separates the body portion including the label mount area from the shoulder area. A first bumper portion can be provided that protrudes radially outward from the body portion above the label mount are upper margin. A second bumper portion can be provided that protrudes radially outward from the body portion below the label mount area lower margin. Outer surfaces of the first and second bumper portions are preferably uniformly spaced from the container longitudinal axis to reduce container-to-container sidewall impact. Even in the event of sidewall impact, the restricted corner radius of the vacuum panels in comparison to some of the other identified features provides a desirable resistance to permanent deformation in all but the most significant sidewall impacts, thereby ensuring both the necessary performance and appearance of the container within the margins of the label mount area.

Other features of thin-walled hot-fill containers of the present invention and the corresponding advantages of those features will be come apparent from the following discussion of a preferred embodiment of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
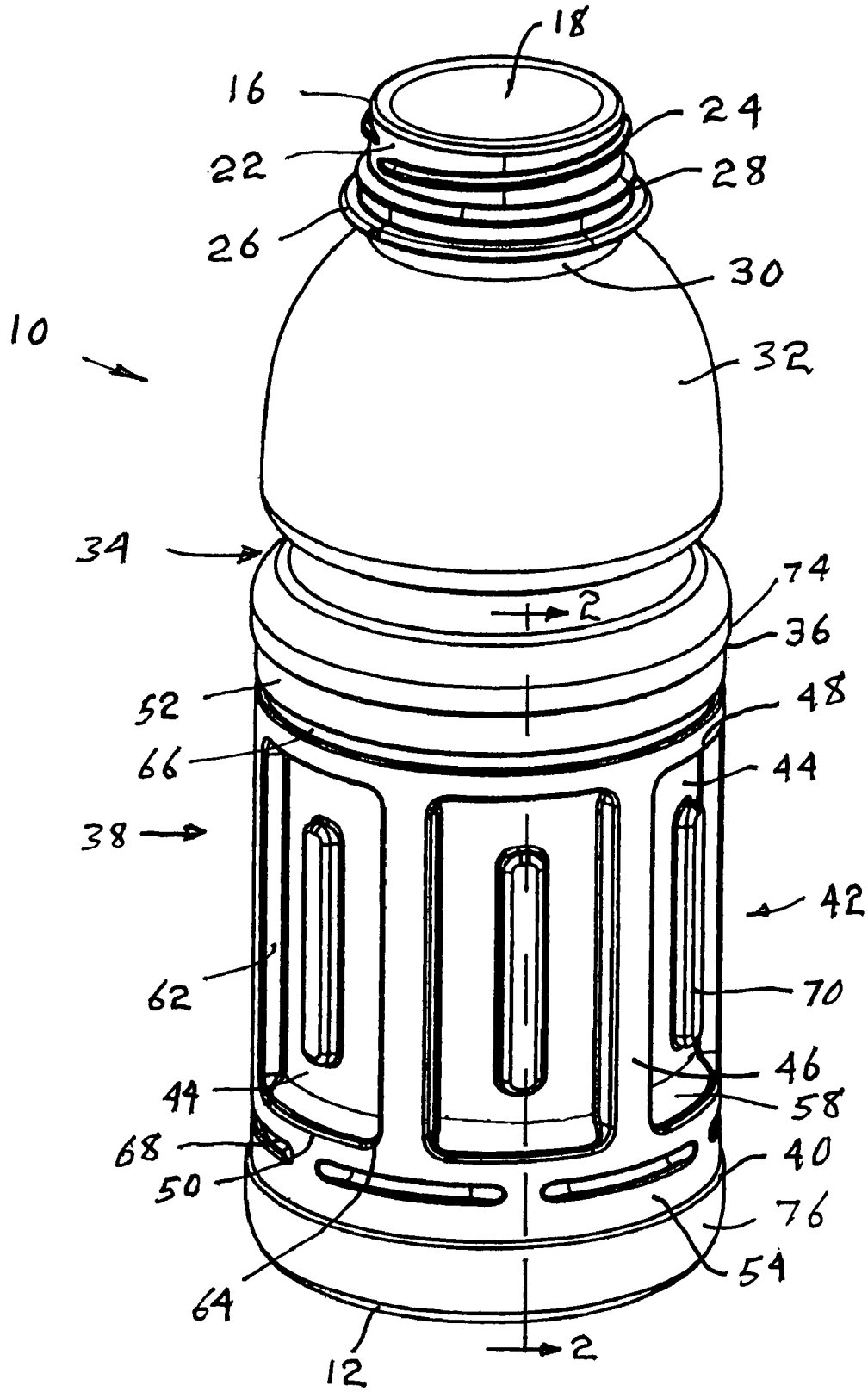
FIG. 1 is a perspective view of a thin-walled hot-fill container of the present invention.
Figure 2:
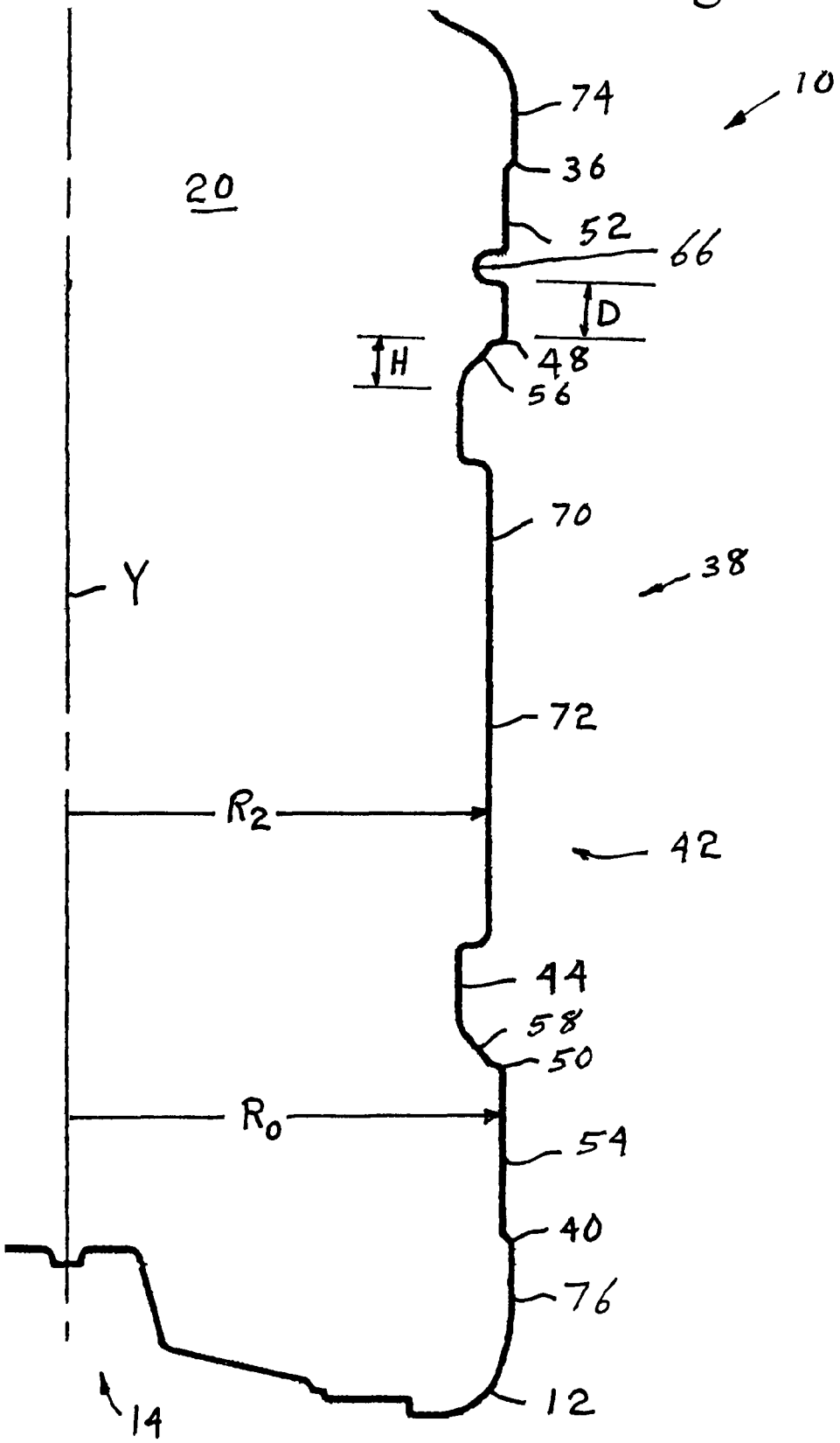
FIG. 2 is a sectional view taken along line 2-2 of FIG. 1.
Figure 4:
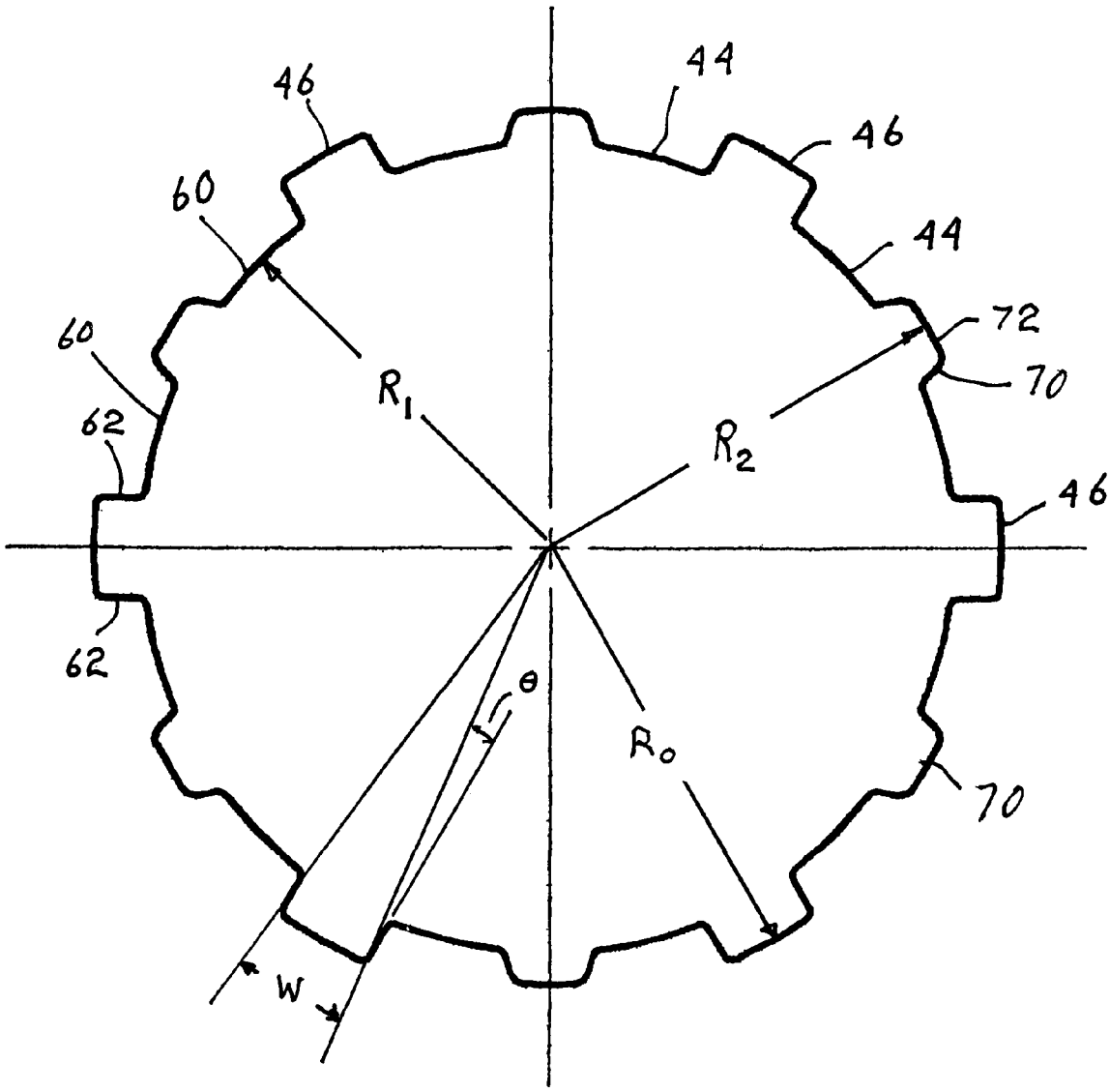
FIG. 4 is a dead horizontal sectional view of the container of FIG. 1 taken through the middle of the vacuum panels.

A thin-walled hot-fill container 10 of the present invention is shown in FIGS. 1, 2 and 4 to include a base 12 on a lower end 14 for generally supporting the container on any underlying substrate such as a shelf or table. An upper end 16 of the container 10 includes an open mouth 18 leading to the interior 20 of the container 10. The mouth 18 is surrounded by a finish 22 that is shown to include a thread 24 for receiving a threaded cap, not shown. A support ring 26 is located at a lower margin of the finish 22, and a pilfer-indicating band engagement ring 28 is located just above the support ring 26. A neck portion 30 is located immediately below the support ring 26. A shoulder portion 32 including a manual grip indention 34 is unitarily joined to the neck portion 30. The shoulder portion 32 is joined by margin 36 to a side wall portion 38 that extends from the shoulder portion 32 down to another margin 40 joining the side wall portion 38 to the base 12. The base 12, margins 36 and 40, shoulder portion 32, neck portion 30, and elements of the finish 22 are rotationally symmetric about the axis Y extending vertically through the center of the container 10. A first bumper portion 74 can be provided that protrudes radially outward from the side wall portion 38 above the upper margin 36. A second bumper portion 76 can be provided that protrudes radially outward from the side wall portion 38 below the lower margin 40. Outer surfaces of the first and second bumper portions 74 and 76 are preferably uniformly spaced from the container longitudinal axis Y to reduce container-to-container sidewall impact.

The side wall portion 38 includes a label mount area 42 bounded by the upper margin 36 and the lower margin 40. A plurality of generally vertically oriented, parallel vacuum panels 44, are situated in the label mount area 42 with a vertical post 46 separating each adjacent pair of vacuum panels 44. An upper edge 48 and a lower edge 50 define the vertical ends of each of the vacuum panels 44. The upper edge 48 is spaced from the upper margin 36 by a cylindrical surface portion 52. Similarly, the lower edge 50 is spaced from the lower margin 40 by a cylindrical surface portion 54. The upper and lower cylindrical surface portions 52 and 54 are of equal radius $R_0$ from the axis Y, and can be employed to receive an adhesive for bonding a label, not shown, within the margins 36 and 40 of the label mount area 42. The upper and lower cylindrical surface portions 52 and 54, taken together with the outer surface of the vertical posts 46, form a substantially continuous surface of radius $R_0$ from the axis Y. The vertical post 46 provided between each pair of adjacent vacuum panels 44 can include stiffening ribs, not shown. The posts 46 have a selected width W, which can be between about 5° and 15° of arc measured from the Y axis.

An indented ring 66 is situated in the upper cylindrical surface portion 52 between the upper margin 36 of the label mount area 42 and the upper edge 48 of the vacuum panels 44. Another indented ring 68 is situated in the lower cylindrical surface portion 54 between the lower margin 40 of the label mount area 42 and the lower edge 50 of the vacuum panels 44. The indented ring 66 is shown to be circumferentially continuous, while indented ring 68 is shown to be segmented or circumferentially discontinuous, however the rings can be of the same character or can be positionally swapped from that shown without any substantial change in performance of the container.

Figure 3:
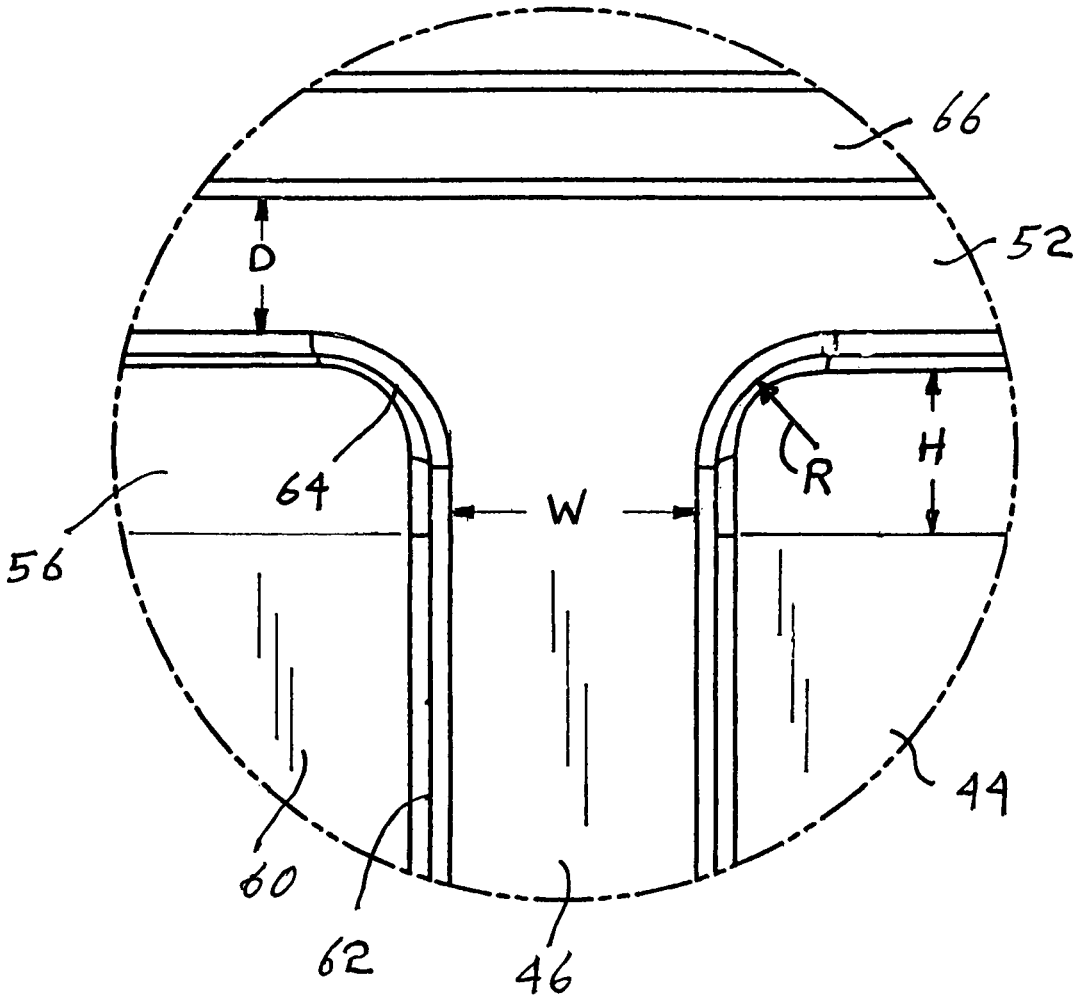
FIG. 3 is a detail elevation view of the corner areas of two adjacent vacuum panels of the container shown in FIG. 1.

The configuration of the vacuum panels 44 is shown in greater detail in FIGS. 2-4. The vacuum panels 44 are generally identical to each other and include an upper inclined area 56 adjacent the upper edge 48 and a lower inclined area 58 adjacent the lower edge 50. The upper edge 48 of the vacuum panels is spaced from the indented ring 66 by a distance D. The spacing between the lower edge 50 and the lower indented ring 68 is also about D. The spacing distance D is generally less than the width W of the posts 46, and can be between about 0.4 and 0.8 W. The measurements of the distances D and W are on the substantially continuous surface of radius $R_0$ from the axis Y. The upper inclined area 56 and lower inclined area 58 of each vacuum panel 44 have a vertical dimension H that is at least as large as D. The inclined areas 56 and 58 are generally symmetric, and can be inclined at an angle of between about 35° and 55° from the horizontal.

Each vacuum panel 44 includes a central depressed region 60 that can be planar or curved, and is shown in FIG. 4 to be cylindrical and spaced from the Y axis by a radius $R_1$ that is less than radius $R_0$. The central depressed region 60 of each vacuum panel 44 is bounded laterally by margins 62 that are substantially perpendicular to the immediately adjacent depressed region 60. The lateral margins 62 can be inclined at an angle θ of between about 3° to 10° with respect to a radius line passing through the Y axis. The lateral margins 62 extend vertically over the entire length of the vacuum panel 44 between corners 64. The corners 64 have a small radius R that is less than or equal to about 1.2 D. The radius R of the corners 64 is also less than or equal to H. This small radius corner structure coupled with the inclined regions 56 and 58 inhibits the deformation of the adjoining cylindrical surface portions 52 and 54 adjacent to the vacuum panel corners.

Each vacuum panel 44 can include a central protruding element 70 that is isolated from the lateral margins 62 and the inclined portions 56 and 58 by the central depressed region 60 that surrounds the element 70. The distance between any central protruding element 70 and the lateral margins 62 can be greater than W. The outwardly protruding central element 70 of each vacuum panel 44 can have a width that is less than W. The outer surface 72 of the outwardly protruding central element 70 can be spaced from the container longitudinal axis Y by a distance $R_2$ that is less than $R_0$.

While these features have been disclosed in connection with the illustrated preferred embodiment, other embodiments of the invention will be apparent to those skilled in the art that come within the spirit of the invention as defined in the following claims.

What is claimed is:

1. A thin walled, plastic container for containing a liquid filled initially in a hot state and then sealed, the container having a longitudinal axis, a finish adapted to receive a closure sealing the container, a neck situated below and supporting the finish, a shoulder portion situated below the neck, a base, and a body portion connecting the shoulder portion to the base, the body portion including upper and lower margins defining a label mount area between the margins, the label mount area comprising a plurality of inwardly recessed vacuum panels, each adjacent pair of vacuum panels being spaced apart from each other by a post of width W, the vacuum panels having upper and lower edges spaced from the upper and lower margins of the label mount area by at least one indented reinforcing ring, the upper and lower edges of each vacuum panel being spaced from the nearest adjacent indented reinforcing ring by a distance D that is less than width W, the upper and lower edges of each vacuum panel including an inclined margin of height H that is greater than distance D, and each of the vacuum panels having corners defined by a radius R that is less than about 1.2 D.

2. The plastic container of claim 1 wherein each vacuum panel includes lateral margins extending vertically between the corners and connecting the adjacent posts to a central depressed region, each lateral margin lying in a plane that is substantially perpendicular to the adjacent surface of the vacuum panel.

3. The plastic container of claim 2 wherein each vacuum panel includes an outwardly protruding central element that is spaced from the lateral margins of the vacuum panel by a distance greater than W.

4. The plastic container of claim 3 wherein the outwardly protruding central element of each vacuum panel has a width that is less than W.

5. The plastic container of claim 3 wherein the outwardly protruding central element of each vacuum panel is spaced from the container longitudinal axis by a distance that is less than the spacing between the posts and the container longitudinal axis.

6. The plastic container of claim 3 wherein the outwardly protruding central element of each vacuum panel is surrounded by a surface spaced a uniform distance from the container longitudinal axis.

7. The plastic container of claim 1 wherein an indented ring separates the body portion including the label mount area from the shoulder area.

8. The plastic container of claim 7 wherein a first bumper portion protrudes radially outward from the body portion above the label mount area upper margin.

9. The plastic container of claim 8 wherein a second bumper portion protrudes radially outward below the label mount area lower margin.

10. The plastic container of claim 9 wherein the first and second bumper portion are spaced from the container longitudinal axis by a same distance.

11. A thin walled, plastic container for containing a liquid filled initially in a hot state and then sealed, the container having a longitudinal axis, a finish adapted to receive a closure sealing the container, a neck situated below and supporting the finish, a shoulder portion situated below the neck, a base, and a body portion connecting the shoulder portion to the base, the body portion including upper and lower margins defining a label mount area between the upper and lower margins, the label mount area comprising a plurality of inwardly recessed vacuum panels separated by vertical posts, the vacuum panels having upper and lower edges spaced from the upper and lower margins of the label mount area by at least one indented reinforcing ring, the upper and lower edges of each vacuum panel being spaced from the nearest adjacent indented reinforcing ring by a distance D, the upper and lower edges of each vacuum panel including an inclined margin of height H that is greater than distance D, and each of the vacuum panels including lateral margins extending vertically between the corners and connecting the adjacent posts to a central depressed region, each lateral margin being inclined at an angle of between about 3° and 10° with respect to an intersecting plane passing through an edge defined by the intersection of said lateral margin and said vertical post and the container longitudinal axis.

12. The plastic container of claim 11 wherein each vacuum panel includes an outwardly protruding central element that is spaced from the lateral margins of the vacuum panel by a distance greater than the width of the protruding central element.

13. The plastic container of claim 12 wherein the outwardly protruding central element of each vacuum panel is spaced from the container longitudinal axis by a distance that is less than the spacing between the posts and the container longitudinal axis.

14. The plastic container of claim 12 wherein the outwardly protruding central element of each vacuum panel is surrounded by a surface spaced a uniform distance from the container longitudinal axis.

15. The plastic container of claim 11 wherein the posts separating each adjacent pair of vacuum panels has a width W that is greater than D.

16. The plastic container of claim 11 wherein an indented ring separates the body portion including the label mount area from the shoulder area.

17. The plastic container of claim 16 wherein a first bumper portion protrudes radially outward from the body portion above the label mount area upper margin.

18. The plastic container of claim 17 wherein a second bumper portion protrudes radially outward below the label mount area lower margin.

19. The plastic container of claim 18 wherein the first and second bumper portion are spaced from the container longitudinal axis by a same distance.

20. A thin walled, plastic container for containing a liquid filled initially in a hot state and then sealed, the container having a longitudinal axis, a finish adapted to receive a closure sealing the container, a neck situated below and supporting the finish, a shoulder portion situated below the neck, a base, and a body portion connecting the shoulder portion to the base, the body portion including upper and lower margins defining a label mount area between the margins, a first bumper portion protruding radially outward from the body portion above the label mount area upper margin, a second bumper portion protruding radially outward below the label mount area lower margin, the first and second bumper portions being spaced from the container longitudinal axis by a same distance, the label mount area comprising a plurality of inwardly recessed vacuum panels separated by vertical posts, the vacuum panels having upper and lower edges spaced from the upper and lower margins of the label mount area by at least one indented reinforcing ring, the upper and lower edges of each vacuum panel being spaced from the nearest adjacent indented reinforcing ring by a distance D, the upper and lower edges of each vacuum panel including an inclined margin of height H that is greater than distance D, and each of the vacuum panels including lateral margins extending vertically between the corners and connecting the adjacent posts to a central depressed region, each lateral margin being located at an angle of between about 3° to 10° to an intersecting plane passing through an edge defined by the intersection of said lateral margin and said vertical post and the container longitudinal axis.

21. The plastic container of claim 11, 12, 13, 14, 15, 16, 17, 18, 19, or 20 wherein the vacuum panels have corners defined by a radius R that is less than 1.2 D.

22. A thin walled, plastic container for containing a liquid filled initially in a hot state and then sealed, the container having a longitudinal axis, a finish adapted to receive a closure sealing the container, a neck situated below and supporting the finish, a shoulder portion situated below the neck, a base, and a body portion connecting the shoulder portion to the base, the body portion including upper and lower margins defining a label mount area between the margins the label mount area comprising a plurality of inwardly recessed vacuum panels separated by vertical posts, the vacuum panels having upper edges spaced from the upper margins of the label mount area by an upper indented reinforcing ring perpendicular to the longitudinal axis and lower edges spaced from the lower margins of the label mount area by a lower indented reinforcing ring perpendicular to the longitudinal axis, at least one of the upper and lower indented rings being circumferentially discontinuous, the upper and lower edges of each vacuum panel being spaced from the nearest adjacent indented reinforcing ring by a distance D, the upper and lower edges of each vacuum panel including an inclined margin of height H that is greater than distance D, each of the vacuum panels including lateral margins extending vertically between the corners and connecting the adjacent posts to a central depressed region, each lateral margin being inclined at an angle of between about 3° and 10° with respect to an intersecting plane passing through an edge defined by the intersection of said lateral margin and said vertical post and the container longitudinal axis, and each of the vacuum panels have corners defined by a radius R that is less than 1.2 D.

* * * * *